US009701442B1

(12) United States Patent
Heinrichs et al.

(10) Patent No.: US 9,701,442 B1
(45) Date of Patent: Jul. 11, 2017

(54) GENERAL USE OF A STRAPLESS PALLET

(71) Applicants: Mark A. Heinrichs, Brielle, NJ (US); Gregory Bender, South Bound Brook, NJ (US)

(72) Inventors: Mark A. Heinrichs, Brielle, NJ (US); Gregory Bender, South Bound Brook, NJ (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 325 days.

(21) Appl. No.: 14/121,631

(22) Filed: Sep. 30, 2014

(51) Int. Cl.

| | |
|---|---|
| ***F42B 39/00*** | (2006.01) |
| ***B65D 19/44*** | (2006.01) |
| ***B65D 19/06*** | (2006.01) |
| ***F42B 39/26*** | (2006.01) |

(52) U.S. Cl.
CPC ..... *B65D 19/44* (2013.01); *B65D 19/06* (2013.01); *F42B 39/26* (2013.01)

(58) Field of Classification Search
CPC ..... B65D 71/70; F42B 39/00; F42B 39/14; F42B 39/24; F42B 39/26; F42B 39/28
USPC ..... 206/3, 386, 443, 446, 509, 511; 108/53.1, 55.1, 55.3, 55.5; 220/1.5
See application file for complete search history.

(56) References Cited

U.S. PATENT DOCUMENTS 2,530,797 A * 11/1950 Arthur ..... B65D 71/02 206/3
2,670,984 A * 3/1954 Arthur ..... B65D 71/02 206/3
2,774,474 A 12/1956 Phillips
3,160,060 A * 12/1964 Zsoka ..... F41F 3/042 206/3
4,440,296 A 4/1984 Howe et al.
5,323,903 A * 6/1994 Bush ..... B65D 19/0018 206/386
5,351,629 A 10/1994 Breezer et al.
5,429,236 A * 7/1995 Evans ..... B65D 19/0016 108/55.1
5,540,334 A * 7/1996 Haas ..... B65D 25/108 206/446
5,887,529 A 3/1999 John et al.
5,950,546 A 9/1999 Brown et al.
(Continued)

FOREIGN PATENT DOCUMENTS

FR 2742222 6/1997

OTHER PUBLICATIONS

New Strapless Bomb Pallet Design to Improve Fleet Efficiency, www.navy.mil/search/print.asp?story_id=3913&VIRIN=1362 &imagetrype=1&page=1.

*Primary Examiner* — Luan K Bui
(74) *Attorney, Agent, or Firm* — Fredric J. Zimmerman

(57) ABSTRACT

A transport and storage pallet device with modular, self-contained, and collapsible features is described. The device includes a top frame, a bottom frame, a linking system, hooks, hoist rings, and a collapsing mechanism. The top frame and the bottom frame each include a topside and an underside. The topside of the bottom frame is configured with modular inserts to accommodate full or partial loads of varying sizes. The linking system includes rods extending from and connecting the top frame to the bottom frame. The rods are extensible in length such that the distance between the top frame and the bottom frame is sufficient to secure full or partial loads of varying sizes.

21 Claims, 12 Drawing Sheets

(56) References Cited

U.S. PATENT DOCUMENTS

| | | | | |
|---|---|---|---|---|
| 6,029,583 | A | 2/2000 | LeTrudet | |
| 6,286,792 | B1 * | 9/2001 | Best | B65D 19/08 108/53.1 |
| 6,502,696 | B2 | 1/2003 | Heinrichs | |
| 6,805,061 | B2 | 10/2004 | Smyers et al. | |
| 7,044,065 | B2 * | 5/2006 | Arai | B65D 19/12 108/53.1 |
| 7,546,917 | B1 * | 6/2009 | Lam | B65D 71/70 206/3 |
| 7,921,784 | B2 | 4/2011 | Ogburn et al. | |
| 8,327,775 | B2 | 12/2012 | Fox Harris | |
| 8,875,894 | B2 * | 11/2014 | Ness | B65G 1/02 108/55.3 |

* cited by examiner

GENERAL USE OF A STRAPLESS PALLET

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to storage and shipping pallets.

2) Description of Prior Art

Transport and storage devices such as pallets that enable rapid assembly and breakdown are increasingly important for efficient packaging and mobility of materials. However, existing palletized systems are limited by time consuming packaging that requires extraneous parts such as steel banding and additional customization to secure loads. Furthermore, partial loads are not easily accommodated due to a lack of modularity in palletized systems or unequal weight distribution across such pallets caused by the partial load, rendering the loads susceptible to damage.

In general, a wide variety of pallets and containers are known for transporting cargo and for use with equipment such as fork lifts and pallet trucks. These pallets include one frame or two frames and can be configured to accommodate the various material handling devices needed to move and transport the pallet. For example, in a related art, a strapless pallet includes a top frame and bottom frame with saddles is configured to hold cylindrical objects such as bombs between the two frames. The pallet requires separate tools to secure transported objects within the pallet. In another related art, a transport pallet includes a single frame with receptacles and optional corner posts to increase stability. The underside surface of the frame includes feet for fork lift handling, and the frame can be used with straps for securing the load. A separate top frame is not included in the pallet structure, and separate straps are needed to secure the load.

In a further related art, a pallet structure forms an anti-propagation explosive packaging. The pallet includes a top frame and a bottom frame, and munitions are placed between the two frames. Panels extend from the top frame to the bottom frame to act as shields. Lifting rings are included on the upper surface of the top frame. The underside surface of the top frame includes openings to stabilize the top forward end of munitions. Wooden feet on the underside of the bottom frame enable fork lift handling of the pallet structure. The pallet structure is customized for particular munitions, requires separate tools to buildup and breakdown, is not adjustable and is not collapsible.

In an additional related art, a single-frame pallet includes two adjoining decks to reduce impact upon the frame imparted by a fork lift. The decks include opposing mating areas and latch members in order to securely adjoin the decks in an assembled configuration. Transported objects are placed and secured on top of the single-frame pallet. Additionally, related art recite structural features associated with single-frame pallets having two adjoining decks.

The United States Army and the United States Marine Corps use wooden pallets, steel banding, custom wooden adapters and spacers to ship and store loads such as artillery rounds and ammunition boxes. These materials are often discarded after use rather than being reused or recycled. These pallets are time-consuming to load and reconfiguration for partial loads is difficult. Tools are required to cut the steel banding and to access the pallet load. Furthermore, palletizing tools are required to rebuild the load when necessary. Wooden materials need to be treated for nematodes and other pests. Extraneous tools and supplies are needed to assemble, load, and break-down pallets. Additionally, many of these systems do not accommodate material handling equipment (MHE) devices such as conveyors, fork lifts, slings and pallet trucks. All of these factors result in costly and inefficient systems for transport and storage using palletized devices.

SUMMARY OF THE INVENTION

Exemplary embodiments of systems and methods in accordance with the present invention are directed to transport and storage devices such as pallet devices for transport and storage of cargo. These pallet devices are self-contained, eliminating the requirement for additional tools to assemble the pallet devices and secure cargo loads to the pallet devices, modular, facilitating configuration for a wide variety of cargo loads including partial cargo loads, and collapsible, facilitating storage and recovery of used and empty pallet devices.

In one exemplary embodiment, the transport and storage device is modular to accommodate full or partial loads of varying sizes, arrangements and shapes. The transport and storage device includes a top frame, a bottom frame and a linking system disposed between the top and bottom frame. The top frame and the bottom frame each have a topside and an underside. The topside of the bottom frame faces the underside of the top frame, and cargo or other loads are disposed between the topside of the bottom frame and the underside of the top frame. In an exemplary embodiment, the transport and storage device includes one or more modular inserts disposed in at least one of the topside of the bottom frame and the underside of the top frame.

The linking system links and secures the top frame to the bottom frame. Suitable linking systems include, but are not limited to, sets of paired rods and adjustable frames. In one embodiment, the linking system includes sets of paired rods. The paired rods extend from and connect the top frame to the bottom frame. In an exemplary embodiment, the paired rods are extensible rods. In one exemplary embodiment, the paired rods may be adjusted in length such that the distance between the top frame and the bottom frame is sufficient to secure both full and partial loads and cargo of varying sizes. In one exemplary embodiment, each set of paired rods includes one attached end and two free ends.

In one exemplary embodiment, the top frame of the device includes a plurality of divisible units. Each divisible unit is separately adjustable such that the distance between each divisible unit of the top frame and the bottom frame is used to accommodate full or partial loads of varying sizes. The divisible units of the top frame are separately collapsible with respect to the bottom frame such that the underside of each divisible unit of the top frame is in contact with the topside of the bottom frame. In one exemplary embodiment, each divisible unit of the top frame is independently removable from the transport and storage device.

The modular inserts of the top and bottom frames are adjustable. Therefore, the distance between the top frame and the bottom frame or between at least one of the top frame inserts and the bottom frame inserts accommodate full or partial loads of varying sizes. Suitable materials for the modular inserts include, but are not limited to, rubber, foam, polymer, metal and combinations thereof.

In one exemplary embodiment, the bottom frame includes a plurality of separate units or divisions. Each separate bottom frame unit is adjustable within the bottom frame with respect to the other bottom frame units and the top frame. Therefore, the space between the bottom frame and the top frame may accommodate full or partial loads of varying sizes. In addition, the units or divisions of the bottom frame each may be independently removed from the bottom frame of the transport and storage device, for example, to accommodate weight or space restrictions.

In one exemplary embodiment, the top frame further includes a plurality of hooks attached to the top frame and extending down from the underside of the top frame. Each hook in the plurality of hooks is connected to one of the sets of paired rods and in particular to the connected end of the paired rods. In one embodiment, each hook includes a hook end and lock end. The hook end is disposed on the underside of the top frame and is engaged with the connected end of the paired rods. The lock end is disposed on the topside of the top frame, and the hooks are adjustable with regard to the spacing of the hook end from the underside of the top frame to selectively tighten or loosen the linking system for securing or removing the cargo.

In one exemplary embodiment, the top frame includes a plurality of hoist rings. The hoist rings are disposed on the topside of the top frame and enable latching of the device to a hoisting mechanism.

In one exemplary embodiment the transport and storage device is self-contained with respect to assembly, securing loads, and disassembly. In addition to having a top frame, a bottom frame, and a linking system, the transport and storage device includes hooks, a wrench system, and hoisting rings. Hooks are included to latch and tighten extensible paired rods in a linking system to the top frame of the device. Each hook includes a hook end and lock end. The hook end is disposed on the underside of the top frame, and the lock end is disposed on the topside of the top frame. The hooks are adjusted to fasten the load by tightening the linking system. The wrench system includes at least one wrench disposed on the topside of the top frame. In one exemplary embodiment, the transport and storage device includes a plurality of wrenches. Each wrench is in contact with the lock end of a given hook, and the hook is tightened, i.e., drawn toward the underside of the top frame by the wrench. This wrench secures the top frame to the bottom frame through the linking system. The wrench is configured to collapse into the top frame to secure the hook and to prevent the wrench system from loosening.

Hoist rings are disposed on the topside of the top frame to enable latching of the transport and storage device to slings associated with a hoisting mechanism. The underside of the bottom frame includes a plurality of forklift feet for forklift handling of the transport and storage device. The transport and storage device is configured for handling by material handling equipment such as conveyors, forklifts, pallet trucks and combinations thereof. Furthermore, the topside of the top frame and the underside of the bottom frame are configured to enable vertical stacking of multiple transport and storage devices. A mating configuration is provided on these sides of the frames so that the topside of the top frame and the underside of the bottom frame interface to prevent sideways shifting of the stack transport and storage devices.

In addition to being modular and self-contained, the completely self-contained transport and storage device is collapsible, i.e., the underside of the top frame is brought into contact with the top side of the bottom frame. The transport and storage device in its collapse state includes all of the components required for re-expansion and use, including the top frame, bottom frame, linking system, hooks, wrenches, hoisting rings and modular cargo components.

In one exemplary embodiment, the transport and storage device also includes a collapsing mechanism. The collapsing mechanism positions the various components of the transport and storage device into a collapsed configuration such that the device takes a minimal amount of volume and is easily transportable. The collapsed configuration includes a top surface corresponding to the top side of the top frame and a bottom surface corresponding to the underside of the bottom surface. Even in the collapse configuration, the top surface of the transport and storage device may be used to hold strapped loads for transport of storage.

Suitable materials of any of the top frame, the bottom frame, the linking system, the hooks, the wrench system, and the hoist rings include, but are not limited to steel, aluminum, titanium, carbon fiber, polymer and combinations thereof.

BRIEF DESCRIPTION OF THE DRAWINGS

It will be understood that many additional changes in details, materials, steps, and arrangements of parts which have been described herein and illustrated in order to explain the nature of the invention, may be made by those skilled in the art within the principle and scope of the invention as expressed in the appended claims.

DETAILED DESCRIPTION OF THE INVENTION

In the description which follows, any reference to either direction or orientation is intended primarily and solely for purposes of illustration and is not intended in any way as a limitation on the scope of the present invention. Also the particular embodiments described herein, although exemplary, are not to be considered as limiting of the present invention.

Figure 12:
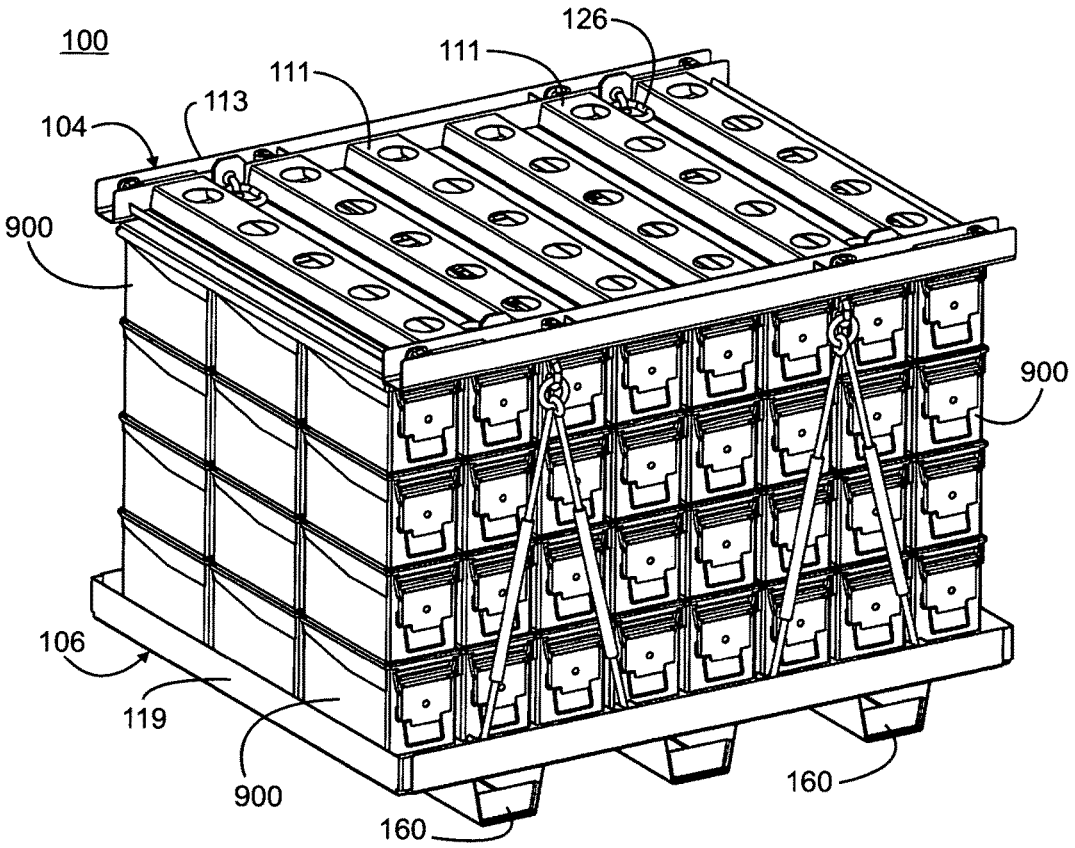
FIG. 12 is top a perspective view an embodiment of a transport and storage device in accordance with the present invention containing an alternative load.

Referring initially to the figures, exemplary embodiments in accordance with the present invention are directed to a modular and collapsible transport and storage device 100 such as a pallet. The transport and storage device is general use transport and storage device that can be used for the transportation and storage of any type of cargo load including munitions 102. The transport and storage device is modular with respect to the type of cargo load as well as with respect to an ability to accommodate both full and partial loads. Suitable cargo load objects include, but are not limited to cylindrical objects or rectangular objects. For example cylinders, gas tanks, boxes, vertical arrangements of artillery rounds 102 or stacks of individual ammunition boxes 900 (FIG. 12) may be accommodated.

Figure 5:
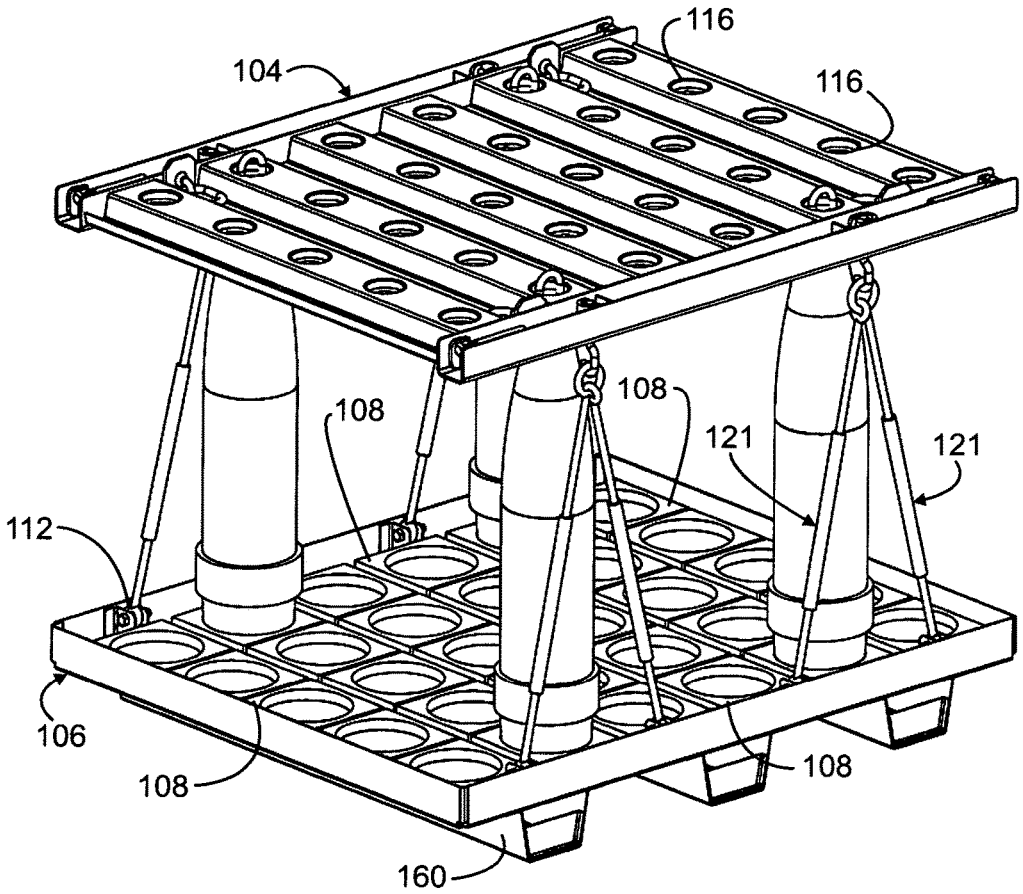
FIG. 5 is a top perspective view of an embodiment of a transport and storage device in accordance with the present invention holding a partial load.
Figure 6:
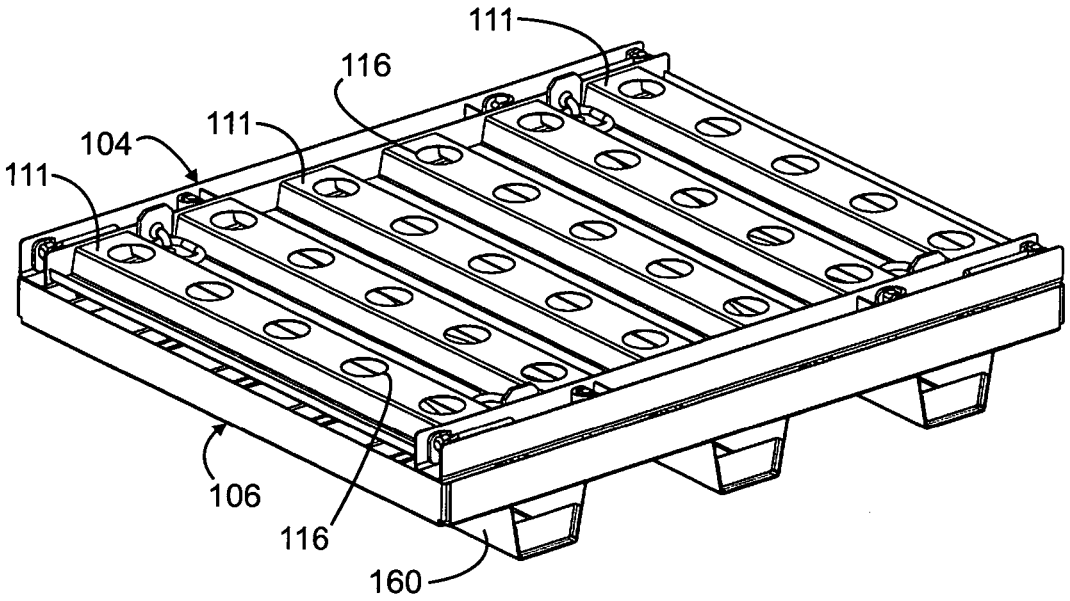
FIG. 6 is a top perspective view of an embodiment of a transport and storage device in accordance with the present invention in a collapsed position.
Figure 7:
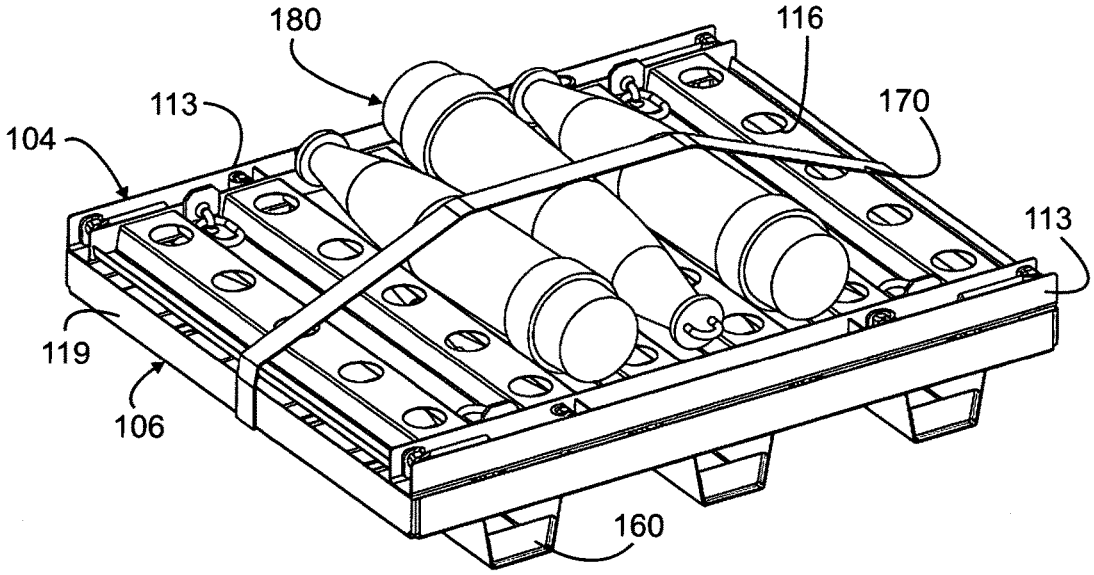
FIG. 7 is perspective view an embodiment of a transport and storage device in a collapsed position with an attached cargo load in accordance with the present invention.

The transport and storage device accommodates cargo loads of varying heights and can be used on both an assembled (FIGS. 1, 2, 4, 12) or collapsed position (FIGS. 6 and 7). The collapsed position facilitates storage of the transport and storage device and minimizes the storage space requirements. This configuration is important after the transport and storage devices are used and returned for re-use. Each transport and storage device is completely self-contained and does not require any additional tools or components to secure full (FIG. 1) or partial loads (FIG. 5) for storage or shipment. Therefore, the cargo loads may be partially removed from the transport and storage device, and the remaining partial load is readily re-secured. Additional tools and materials do not need to be carried with the transport and storage device, and the loads can be quickly secured. This arrangement provides for safe and efficient assembly, loading, and break-down of the transport and storage device and the loads contained within the transport and storage device in remote locations, aboard trucks, ships and airplanes and in tactical locations. All of the components of the transport and storage device stay with the transport and storage device, eliminating waste.

Figure 1:
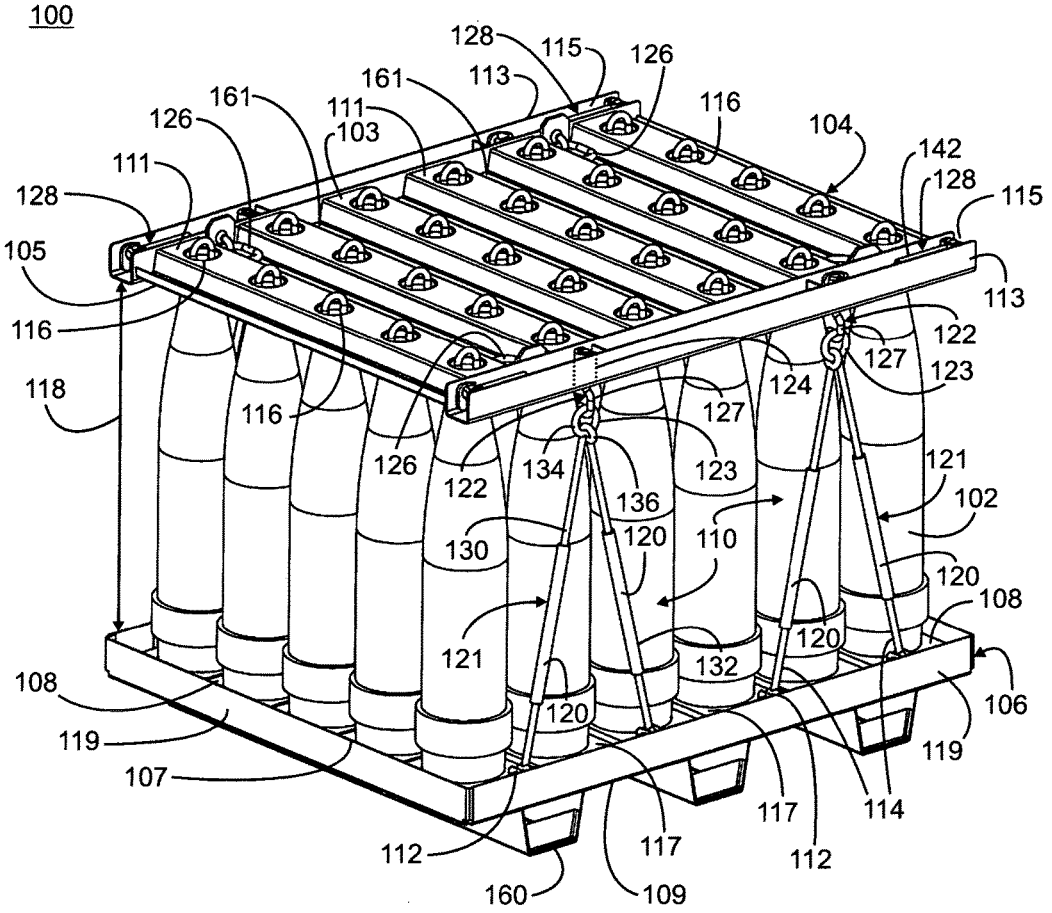
FIG. 1 is a top perspective view of an embodiment of a transport and storage device in accordance with the present invention.
Figure 2:
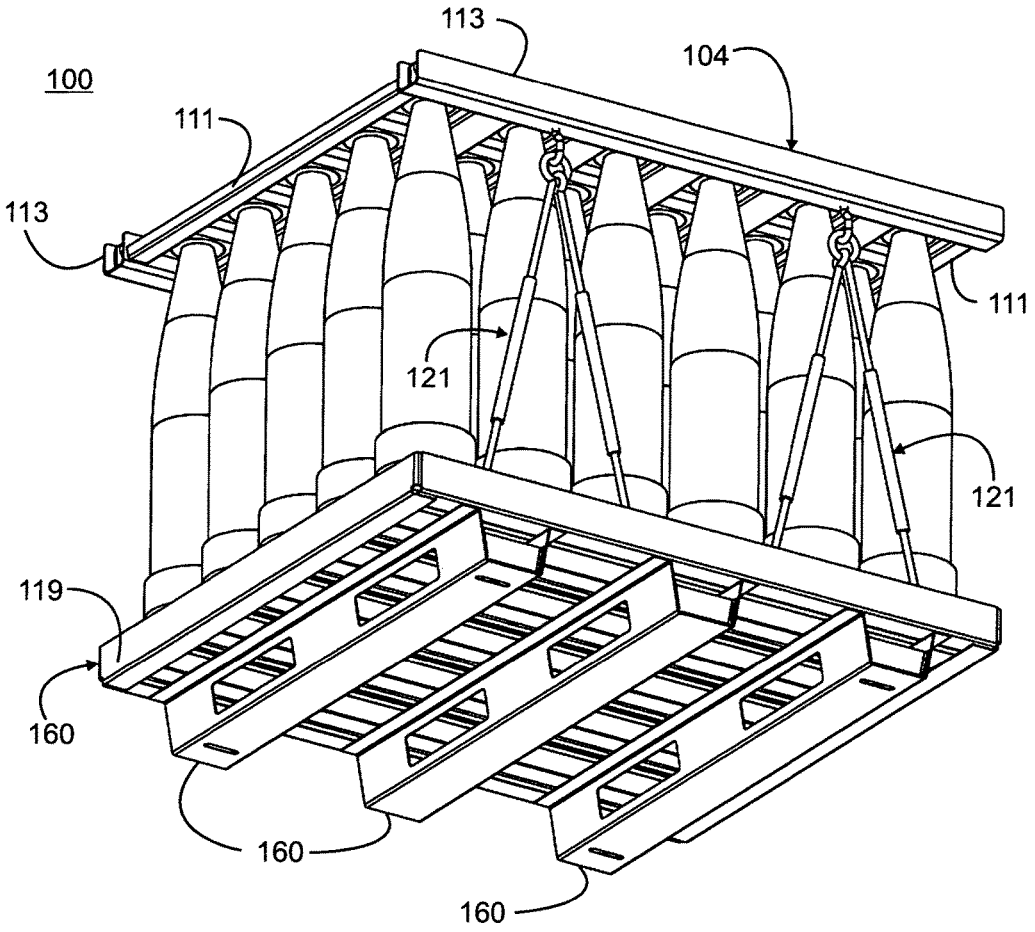
FIG. 2 is a bottom perspective view of an embodiment of a transport and storage device in accordance with the present invention.

As shown in FIG. 1, the modular transport and storage device includes a top frame 104 and a bottom frame 106 spaced from the top frame. In one embodiment, the top frame and bottom frame are independent and separate frames. In one embodiment, the top frame and bottom frame are identical and can be used interchangeably. The top frame includes a top frame topside 103 and top frame underside 105 opposite the top frame topside 103. The bottom frame includes a bottom frame topside 107 and a bottom frame underside 109 opposite the bottom frame topside. The top frame underside faces the bottom frame topside.

The top frame and bottom frame may be solid unitary structures, and in an exemplary embodiment, the top frame and bottom frame are arranged as modular units. This configuration provides for customization based on a given cargo load and even may accommodate heterogeneous cargo loads.

In one exemplary embodiment, the top frame includes a plurality of separate and independent divisible units 111. The divisible units span across the top frame between a pair of top frame side rails 113. Each top frame side rail includes a channel 115 running along its length. Each divisible unit may be independently inserted into and removed from the top frame. Alternatively, each divisible unit is fixedly attached to the top frame side rails. The divisible units of a given top frame may be identical or each can have a unique arrangement. In one exemplary embodiment, each divisible unit includes one or more holes 116 to accommodate portions of the cargo load extending through the top frame.

Similarly, the bottom frame includes a plurality of separate and independent divisible units 117. The number and arrangement of the divisible units in the bottom frame are chosen to complement the number and arrangement of the divisible units in the top frame. The divisible units span across the bottom frame and form the bottom of pan shaped bottom frame defined by a plurality of side frame members 119, e.g., angle iron. Therefore, the bottom frame is generally in the shape of a rectangular pan, and the space in the pan is used to store other parts of the transport and storage device and to accommodate portions of the bottom frame extending down from the top frame underside when the transport and storage device is in a collapsed position.

Each divisible unit in the bottom frame can be independently inserted into and removed from the bottom frame. Alternatively, each divisible unit is fixedly attached to the bottom frame side frame members. The divisible units of a given bottom frame can be identical or each be have a unique arrangement. In one exemplary embodiment, each divisible unit includes one or more holes to accommodate portions of the cargo load extending through the bottom frame.

In one embodiment, the top frame and bottom frame are generally rectangular or square. The size and shape of the top and bottom frames are compatible with conventional shipping pallets. IN an exemplary embodiment, the top frame and bottom have identical length and width dimensions.

The transport and storage device includes a plurality of modular inserts 108 (FIG. 5) located in at least one of the top frame and the bottom frame. The module inserts may be disposed in the divisible units, i.e., each divisible unit is formed with a concavity to accommodate the modular inserts. In addition, the modular inserts may fit into the general pan shape of the bottom frame. The modular inserts 108 may be customized in advance for a given cargo load. Alternatively, each modular insert 108 is formed from a frangible material that may be custom fit on sight for a given cargo load. In one exemplary embodiment, the modular inserts contain an arrangement of different sizes, shapes and materials that are form fit into the top and bottom frames an around the cargo load. Suitable materials for the modular inserts include, but are not limited to, an elastomer, polystyrene, a polymer, a metal, a ceramic and combinations thereof. The modular inserts also may be constructed from flame retardant or ballistic materials.

As shown in FIG. 1, the transport and storage device includes a linking system 110 that connects the top frame to the bottom frame. The linking system secures the top frame to the bottom frame to secure the cargo load in the transport and storage device. The linking system is configured to define the separation height 118 between the top frame and the bottom frame. In addition, the linking system 110 allows for adjustment of this separation height. As the top frame is moveable relative to the bottom frame from a first position, i.e., collapsed position (FIG. 6), with the top frame underside in contact with the bottom frame topside and a second position (FIG. 1) with the top frame underside spaced from the bottom side topside a height defined by the linking system, the linking system may be detached from at least one of the top frame and the bottom frame. In one exemplary embodiment, the linking system is releasably attached to the top frame and fixedly secured to the bottom frame.

Figure 3:
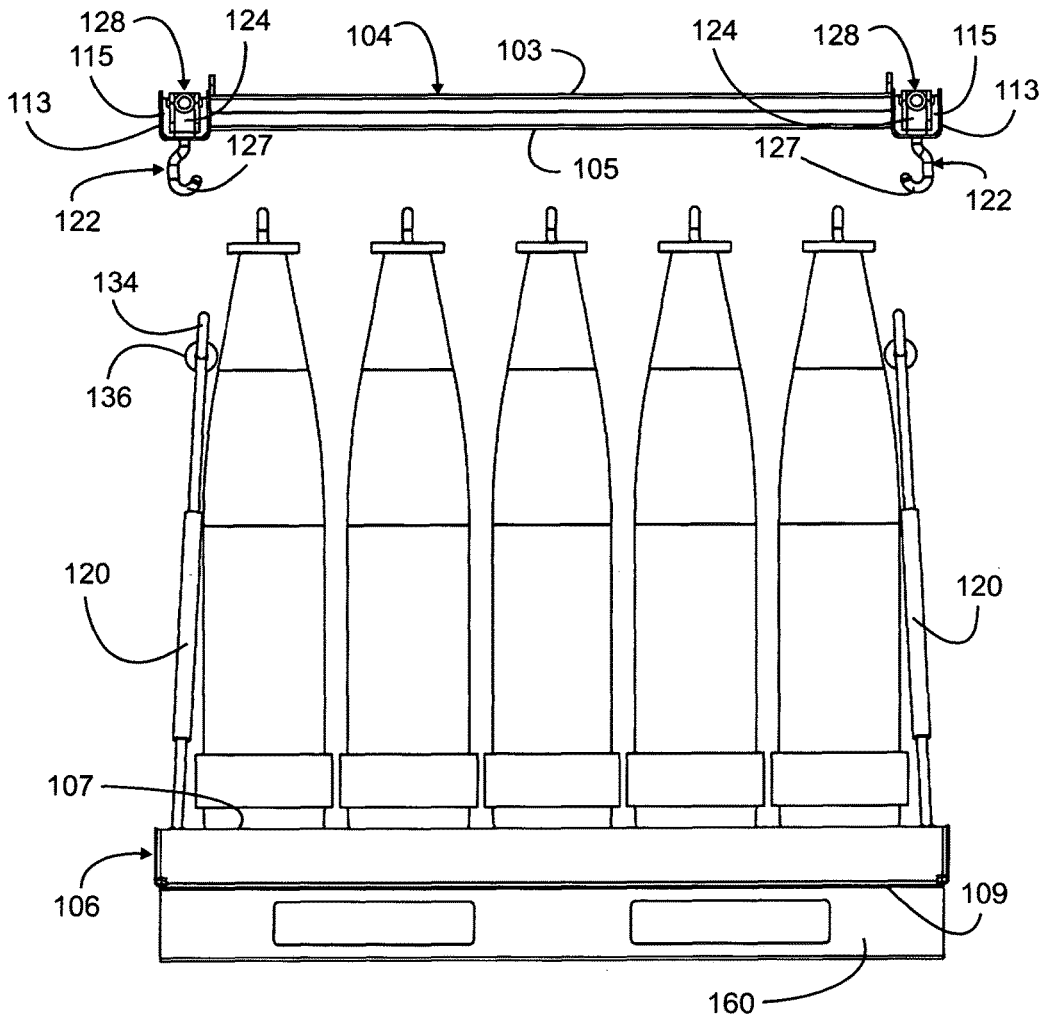
FIG. 3 is a side view of an embodiment of a transport and storage device in accordance with the present invention with the top frame disengaged from the bottom frame.
Figure 4:
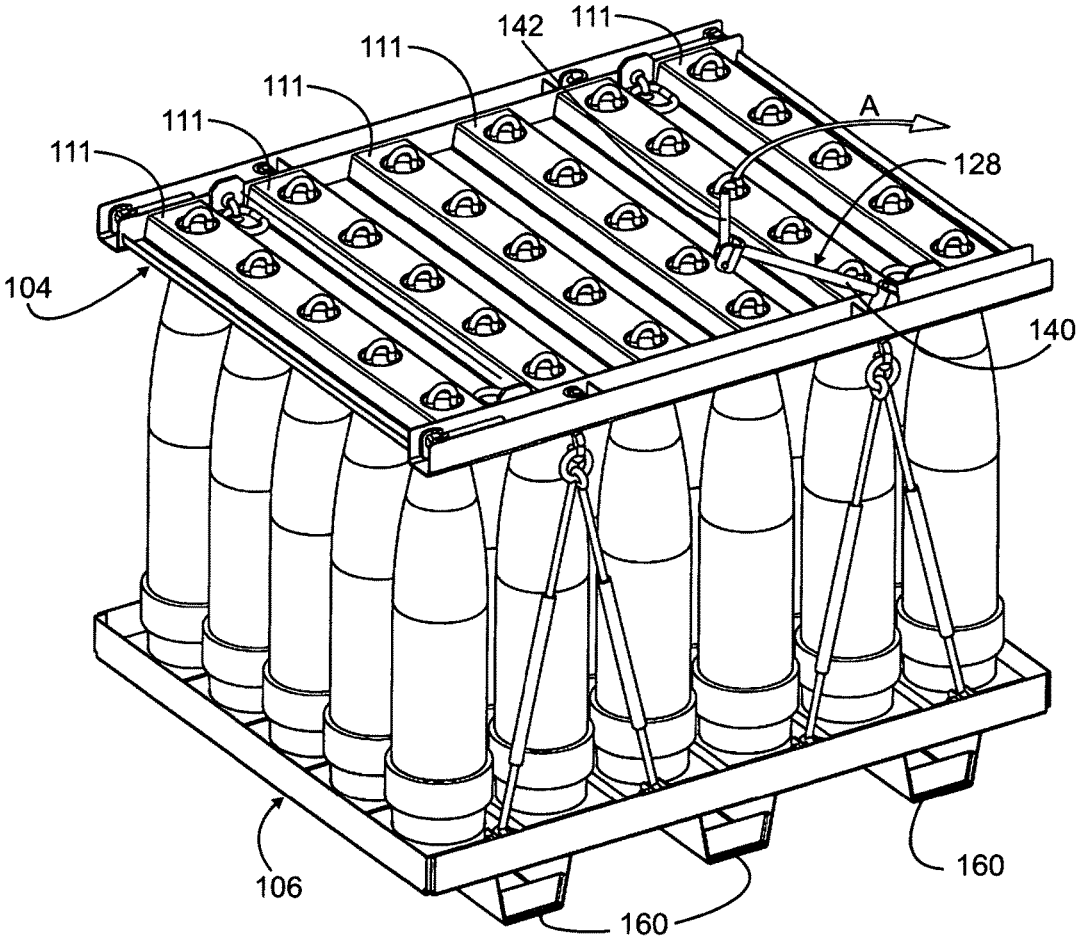
FIG. 4 is another top perspective view of an embodiment of a transport and storage device in accordance with the present invention.

The linking system includes plurality of sets of paired rods 121. In one exemplary embodiment, the linking system includes four sets of paired rods, two each on other side of the rectangular top and bottom frames. Each paired rod is releasably attached to the top frame underside and fixedly secured to the bottom frame topside (FIG. 3). In an exemplary embodiment, each paired rod is extensible along its length such that the height between the top frame 104 and the bottom frame 106 may be adjusted to accommodate and full or partial loads of varying sizes and shapes.

In one exemplary embodiment, each paired rod in a given set of paired rods has a first end 112 pivotally attached to the topside of the bottom frame and a second end 123 opposite the first end. The second end is releasably attached to the top frame underside. Therefore, each paired rod is released from the top frame underside and is placed against the bottom frame topside, or within the pans of the bottom frame, facilitating placement of the transport and storage device in the collapsed position.

To provide for height adjustment, each paired rod includes a length adjustment mechanism 120 such as a threaded turnbuckle disposed between the first and the second end. Rotation of the threaded turnbuckle moves the first end relative to the second end along a length of the paired rod.

As shown in FIG. 1, the linking system includes a plurality of hooks 122 attached to and extending down from the top frame underside. In an exemplary embodiment, one hook is provided for each set of paired rods. The hooks secure each set of paired rods to the top frame. Therefore, each hook is associated with a given set of paired rods and is releasably attached to the second ends of the paired rods.

Figure 11:
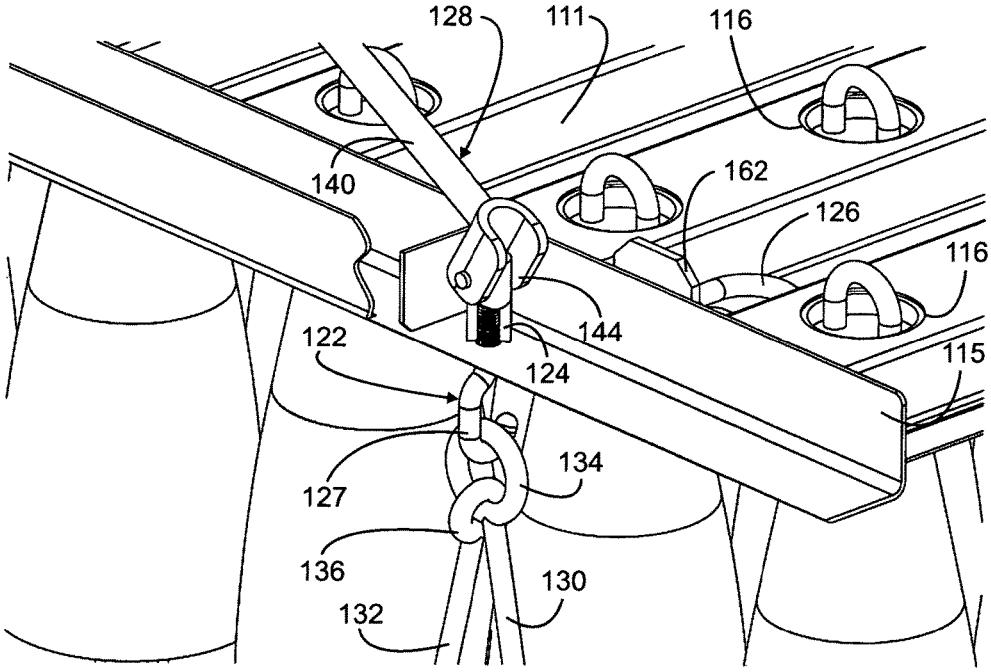
FIG. 11 is a partial cutaway view of an embodiment of two transport and storage devices begin positioned into a stacked arrangement illustrating the wrench system.

As shown in FIG. 11, each hook includes a proximal hook end 127 that is configured as an open hook extending down from the top frame underside and in releasable attachment to the second ends of the paired rods. Each hook also includes a distal lock end 124 moveably attached to the hook end (FIG. 11). Movement of the lock end relative to the hook end changes a distance the hook end extends from the top frame underside. In an exemplary embodiment, the hook extends through the top frame, and the lock end is disposed on and accessible from the top frame topside or within the channel 115. Suitable arranges include a hook end with a threaded shaft passing through the top frame in combination with a lock end configured as a threaded nut engaged on the threaded shaft and disposed in the channel 115. Therefore, turning or rotating the lock end relative to the hook end moves the hook with respect to the top frame underside.

In one exemplary embodiment, each set of paired rods includes a first paired rod 130 and a second paired rod 132. The first paired rod includes a first paired rod second end containing a first paired rod closed loop 134. The hook or hook end is engaged in the first paired rod closed loop. The second paired rod includes a second paired rod second end having a second paired rod closed loop 136. The first paired rod closed loop is interlocked with the second paired rod closed loop. Therefore, both paired rods in each given set of paired rods have a single or common point of attachment with the top frame underside or hook. The first ends of each paired rod in a given set of paired rods, however, attaches to a separate location on the bottom frame topside. This configuration yields a triangular arrangement for each set of paired rods. The triangular arrangement reduces the number of attachment points that need to be adjusted in order to secure the top frame to the bottom frame. In addition, the triangular arrangement provides structural rigidity to the transport and storage device, especially to forces moving lateral or parallel to the top and bottom frames. Additional rigidity is achieved by placing set of paired rods on all four sides of the transport and storage device.

The linking system further comprises a plurality of wrench members 128. In one embodiment, a separate wrench member is provided for each hook. Each wrench member is attached to one of the lock ends. The wrench member is fixedly by moveably secured to the lock end, for example by a pin extending through the lock end threaded nut and the wrench member. Therefore, the wrench member is secured to the transport and storage device and can be used to move the lock end of the hook. Movement of the wrench member moves the lock end relative to the hook end. When the lock end is in threaded engagement with the hook end, rotation of the wrench member rotates the lock end relative to the hook end.

The flexible attachment between the wrench member and the lock end facilitates movement of the each wrench member between an extended position and a folded position. The wrench member, in the folded position, is disposed against the top frame topside and preferably within the channel 115. The wrench member is moved from this folded position in a direction as illustrated by arrow A (FIG. 4) to an extended position. The wrench member moves the lock end of the hook when in the extended position.

In one embodiment the wrench member is constructed from a plurality of articulating members, for example a main shaft 140 having a handle portion 142 pivotally attached to one end and a lock member engaging portion 144 pivotally attached to an opposite end. The lock member engaging portion can be configured as a wrench, and the handle portion is positioned perpendicular to the main shaft in the extended position to supple sufficient torque to the lock member.

Figure 9:
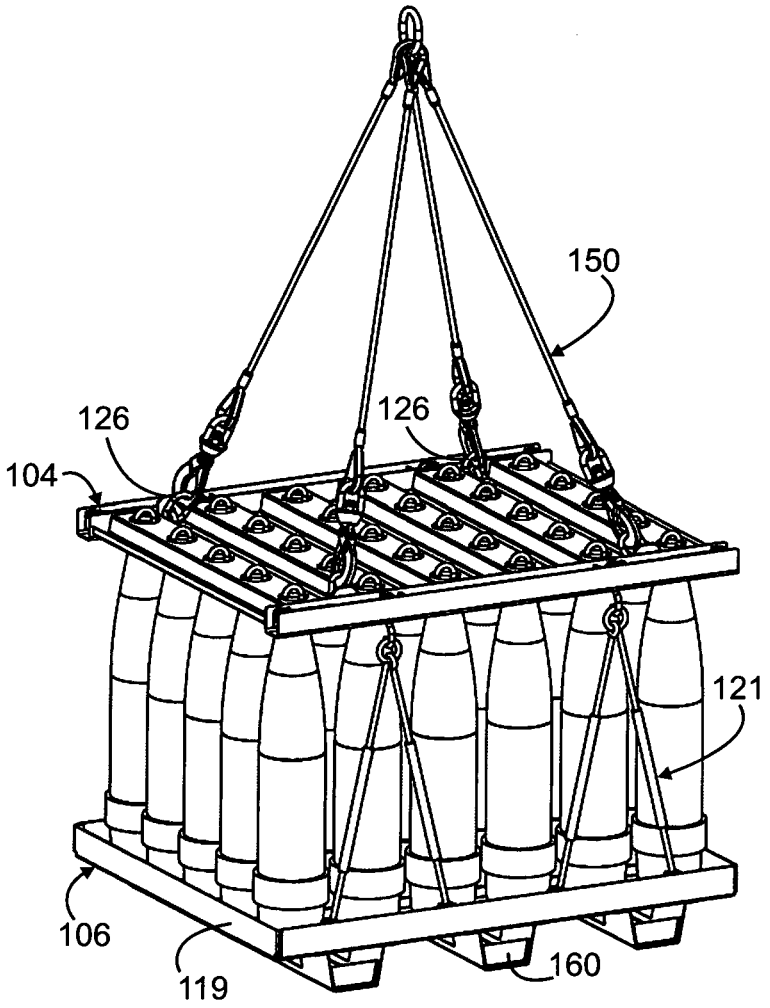
FIG. 9 is a perspective view of an embodiment of a transport and storage device with lifting straps attached in accordance with the present invention.

In one embodiment, the top frame 104 includes a plurality of hoist rings 126 attached to the top frame topside. In one embodiment, the top frame includes four hoist rings. Referring to FIG. 9, the hoist rings allow attachment of the transport and storage device to a hoisting mechanism 150. Suitable hoisting mechanisms are known and available in the art and include crane-type hoisting mechanisms that utilize a plurality of straps and connectors.

Figure 8:
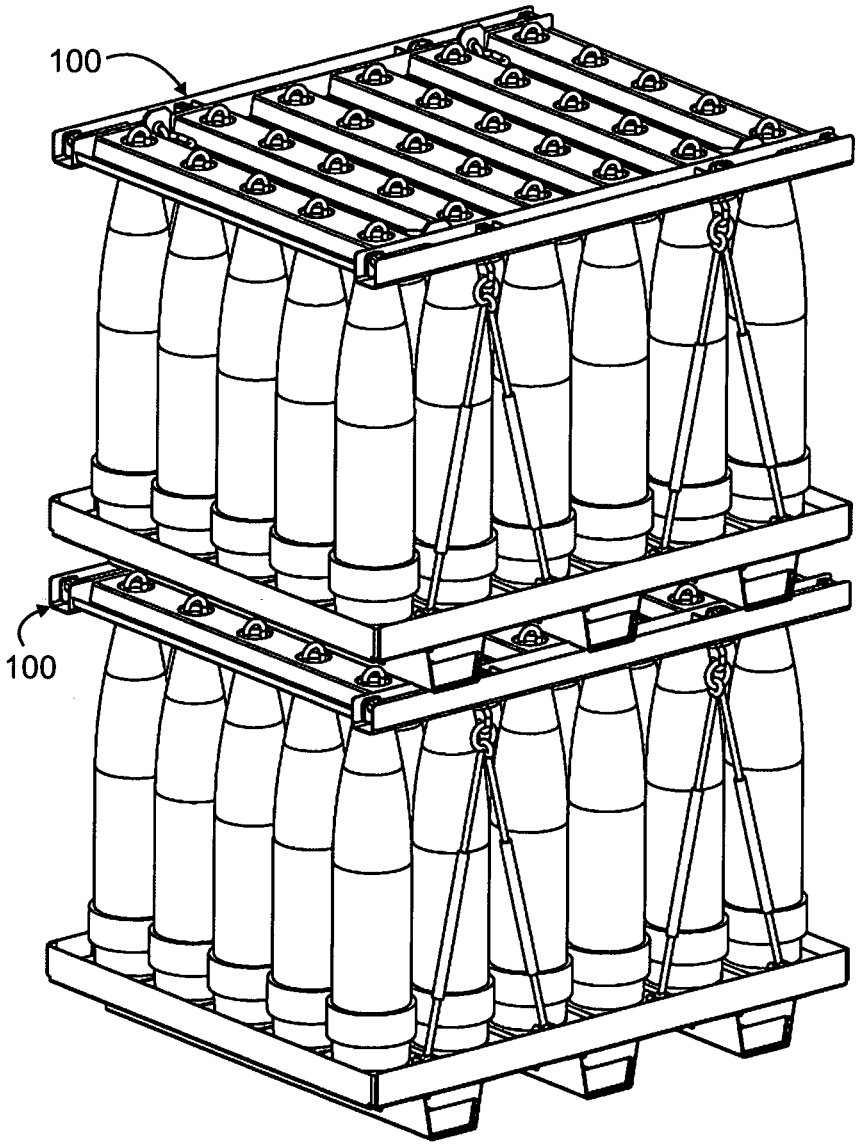
FIG. 8 is a perspective view of a stacked embodiment of a transport and storage device in accordance with the present invention.
Figure 10:
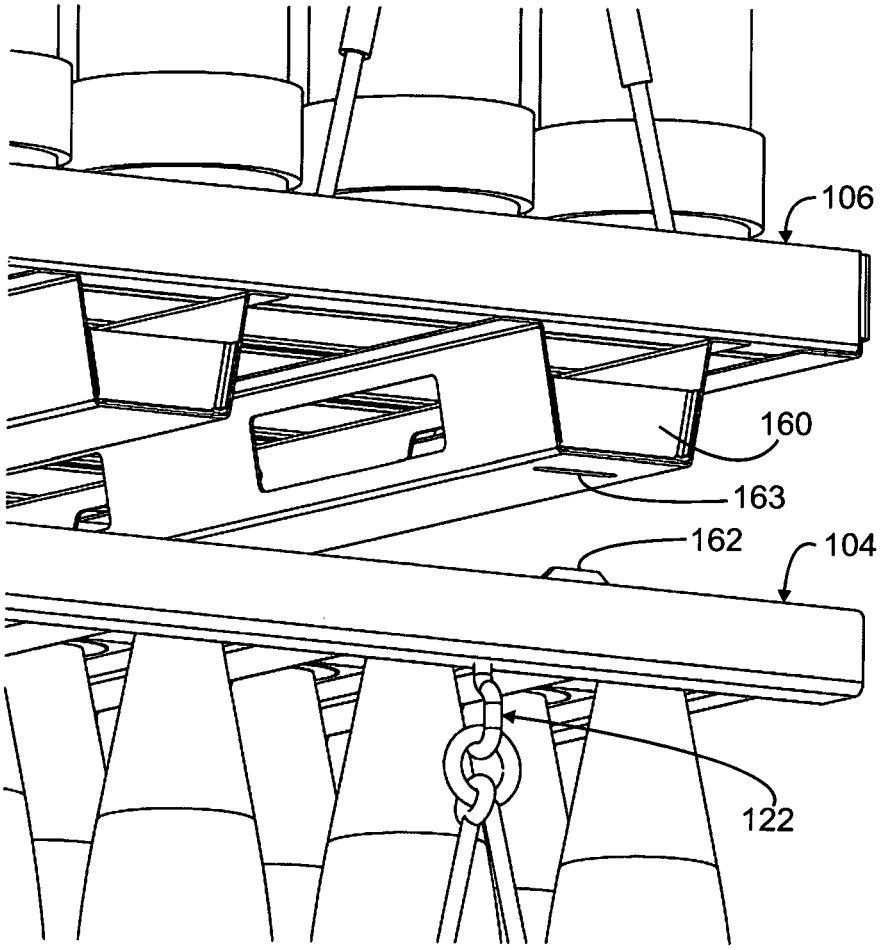
FIG. 10 is a partial view of an embodiment of two transport and storage devices begin positioned into a stacked arrangement.

The self-contained and collapsible transport and storage device includes a plurality of feet 160 attached to and extending down from the bottom frame underside. These feet space the bottom frame underside above the ground or floor and facilitate forklift handling of the transport and storage device. In one embodiment, each foot is configured as an elongated member. The top frame topside can include a plurality of corresponding grooves 161, to facilitate stacking of multiple transport and storage devices in either an expanded or collapsed stated (FIG. 8). In one embodiment as illustrated in FIG. 10, the feet include slits 163 for accepting tangs 162 extending up from the topside of the upper frame. Engaging the tangs in the slits secures the units together in a stacking arrangement to prevent relative lateral movement between the units. Therefore, the topside of the top frame 104 and the underside of the bottom frame 106 are configured to enable stacking of multiple devices. Furthermore, the transport and storage device is configured for handling by material handling equipment such as conveyors, forklifts and pallet trucks.

Suitable materials for any of the top frame, the bottom frame and the linking system include, but are not limited to steel, aluminum, titanium, carbon fiber, a polymer or combinations thereof.

Referring now to FIGS. 6 and 7, a transport and storage device is shown is collapsed configuration. Even in the collapsed configured, the transport and storage device is completely self contained and includes all of the components and tools necessary to place and load between the top and bottom frames and to secure those loads. In addition, the transport and storage device functions as a conventional pallet system in the collapsed configuration. Additional cargo loads 180 are placed on top frame topside and secured with one of more straps 170. The channels accommodate cylindrical cargo, and the hoist rings and feet still provide lifting functionality. In general, the collapsing mechanism reduces the volume consumed by the device to facilitate the transport and storage of an empty pallet device.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A transport and storage device, comprising:

a bottom frame, the bottom frame comprises a bottom frame topside and a bottom frame underside opposite the bottom frame topside;

a top frame, the top frame comprises a top frame topside and a top frame underside opposite the top frame topside, the top frame underside faces the bottom frame topside;

a linking system, the linking system comprises a plurality of sets of paired rods, each of said plurality of sets of paired rods comprises an extensible rod, releasably attached to the top frame underside and fixedly secured to the bottom frame topside; and a plurality of modular inserts disposed on the bottom frame topside, wherein the modular inserts are further disposed on the top frame underside.

2. The transport and storage device of claim 1, wherein the top frame further comprises a plurality of separate divisible units, each of said plurality of separate divisible units is independently removable from the top frame.

3. The transport and storage device of claim 1, wherein the bottom frame further comprises a plurality of separate divisible units, each of the plurality of divisible units is independently removable from the top frame.

4. The transport and storage device of claim 1, wherein the modular inserts comprise at least one of an elastomer, polystyrene, a polymer, a metal, and a ceramic.

5. The transport and storage device of claim 1, wherein said each paired rod in a given set of paired rods comprises a first end pivotally attached to the topside of the bottom frame and a second end opposite the first end, and wherein the second end is releasably attached to the top frame underside.

6. The transport and storage device of claim 5, wherein said each paired rod comprises a threaded turnbuckle disposed between the first and the second end, rotation of the threaded turnbuckle moving the first end relative to the second end along a length of the paired rod.

7. The transport and storage device of claim 5, wherein the linking system further comprises a plurality of hooks, which are attached to the top frame and extend from the top frame underside, and wherein each hook of the plurality of hooks associated with said given set of paired rods and in releasable attachment to the second ends.

8. The transport and storage device of claim 5, wherein the linking system further comprises a plurality of hooks, which are attached to the top frame and extend from the top frame underside, wherein each hook of the plurality of hooks associated with said given set of paired rods and in releasable attachment to the second ends, wherein each said given set of paired rods comprises a first paired rod second end and a second paired rod second end, wherein said first paired rod second end comprises a first paired rod closed loop, wherein said each hook of said plurality of hooks engaged in respective said first paired rod closed loop and wherein the second paired rod second end comprises a second paired rod closed loop, and wherein the first paired rod closed loop interlocked with the second paired rod closed loop.

9. The transport and storage device of claim 5, wherein the linking system further comprises a plurality of hooks, which are attached to the top frame and extend from the top frame underside, wherein each hook of the plurality of hooks associated with said given set of paired rods and in releasable attachment to the second ends, wherein said each hook comprises a hook end in releasable attachment to the second ends and a lock end moveably attached to the hook end, and wherein movement of the lock end relative to the hook end changes a distance the hook end extends from the top frame underside.

10. The transport and storage device of claim 5, wherein the linking system further comprises a plurality of hooks, which are attached to the top frame and extend from the top frame underside, wherein each hook of the plurality of hooks associated with said given set of paired rods and in releasable attachment to the second ends, wherein said each hook comprises a hook end in releasable attachment to the second ends and a lock end moveably attached to the hook end, wherein the linking system further comprises a plurality of wrench members, wherein each wrench member of the plurality of wrench members is attached to one of the lock end, and wherein a movement of the wrench member moves the lock end relative to the hook end.

11. The transport and storage device of claim 5, wherein the linking system further comprises a plurality of hooks, which are attached to the top frame and extend from the top frame underside, wherein each hook of the plurality of hooks associated with said given set of paired rods and in releasable attachment to the second ends, wherein said each hook comprises a hook end in releasable attachment to the second ends and a lock end moveably attached to the hook end, wherein the linking system further comprises a plurality of wrench members, wherein each wrench member of the plurality of wrench Members is attached to one of the lock end, wherein the lock end is in threaded engagement with the hook end, and wherein a rotation of the wrench member rotates the lock end relative to the hook end.

12. The transport and storage device of claim 5, wherein the linking system further comprises a plurality of hooks, which are attached to the top frame and extend from the top frame underside, wherein each hook of the plurality of hooks associated with said given set of paired rods and in releasable attachment to the second ends, wherein said each hook comprises a hook end in releasable attachment to the second ends and a lock end moveably attached to the hook end, and wherein movement of the lock end relative to the book end changes a distance the hook end extends from the top frame underside, wherein the linking system further comprises a plurality of wrench members, wherein each wrench member of the plurality of wrench members is attached to one of the lock end, movement of the wrench member moving the lock end relative to the hook end, wherein each wrench member comprises an extended position and a folded position, and wherein the wrench member is configured to move the lock end when in the extended position and disposed in a recess channel in the top frame when in the folded position.

13. The transport and storage device of claim 1, wherein the top frame further comprises a plurality of hoist rings attached to the top frame top side.

14. The transport and storage device of claim 1, wherein the bottom frame underside comprises a plurality of feet, which extend down from the bottom frame underside.

15. The transport and storage device of claim 1, wherein the top frame is comprised of at least one of steel, aluminum, titanium, carbon fiber, and a polymer.

16. The transport and storage device of claim 1, wherein the bottom frame is comprised of at least one of steel, aluminum, titanium, carbon fiber, and a polymer.

17. The transport and storage device of claim 1, wherein the linking system is comprised of at least one of steel, aluminum, titanium, carbon fiber, and a polymer.

18. The transport and storage device of claim 1, wherein the top frame is moveable relative to the bottom frame from a first position with the top frame underside in contact with the bottom frame topside and a second position with the top frame underside spaced from the bottom side topside a height defined by the linking system.

19. The transport and storage device of claim 18, wherein each paired rod disengages from the top frame underside and in contact with the bottom frame topside along its entire length when the top frame underside contacts with the bottom frame topside.

20. The transport and storage device of claim 18, wherein the top frame topside is configured to accommodate strapped cargo loads when the top frame underside contacts the bottom frame topside.

21. A transport and storage device, comprising:

a bottom frame, the bottom frame comprises a bottom frame topside, a bottom frame underside opposite the bottom frame topside and a plurality of feet extending down from the bottom frame underside;

a top frame, the top frame comprises a top frame topside and a top frame underside opposite the top frame topside, wherein the top frame comprises a plurality of hoist rings attached to the top frame top side, and wherein the top frame underside faces the bottom frame topside; and a linking system, the linking system comprises a plurality of sets of paired rods, each of the plurality of sets of paired rods comprises an extensible rod, the extensible rod comprises a first end pivotally attached to the topside of the bottom frame, a second end opposite the first end and releasably attached to the top frame underside and a threaded turnbuckle disposed between the first and the second end, and wherein rotation of the threaded turnbuckle moves the first end relative to the second end along a length of the paired rod;

a plurality of hooks attached to the top frame and extend from the top frame underside, each of the plurality of hooks is associated with a given set of paired rods and in releasable attachment to a respective said second ends, each hook comprises a hook end in releasable attachment to the second ends and a lock end moveably attached to the hook end, wherein the lock end is in threaded engagement with the hook end and a rotation of the lock end relative to the hook end changes a distance the hook end extends from the top frame underside; and a plurality of wrench members, each of the plurality of wrench members is attached to one of the lock ends, a rotation of said each of the plurality of wrench members rotate the lock end relative to the hook end, each of the plurality of wrench members comprises an extended position and a folded position, the wrench member is configured to rotate the lock end when in the extended position and disposed in a recess channel in the top frame when in the folded position.

* * * * *